US007296382B2

(12) United States Patent
Sack

(10) Patent No.: US 7,296,382 B2
(45) Date of Patent: Nov. 20, 2007

(54) INJECTION MOLDED THERMOPLASTIC INSERT

(75) Inventor: James A. Sack, Elverson, PA (US)

(73) Assignee: Pennsylvania Insert Corp., Spring City, PA (US)

( * ) Notice: Subject to any disclaimer, the term of this patent is extended or adjusted under 35 U.S.C. 154(b) by 787 days.

(21) Appl. No.: 10/753,630

(22) Filed: Jan. 8, 2004

(65) Prior Publication Data

US 2004/0168375 A1 Sep. 2, 2004

Related U.S. Application Data

(60) Provisional application No. 60/439,013, filed on Jan. 9, 2003.

(51) Int. Cl.
*E04C 5/12* (2006.01)
*E04G 21/12* (2006.01)

(52) U.S. Cl. ..... 52/125.5; 52/704; 411/82; 411/188; D8/397; 294/89

(58) Field of Classification Search ..... 411/82, 411/188; 52/125.4, 125.5, 699, 704, 708, 52/122.1, 125.1; 294/89; D8/397
See application file for complete search history.

(56) References Cited

U.S. PATENT DOCUMENTS 2,039,420 A * 5/1936 Isett ..... 404/74
2,873,765 A * 2/1959 Gregory ..... 138/96 R
3,418,781 A * 12/1968 Penote ..... 52/699
D223,231 S * 4/1972 Miller ..... D8/385
D231,328 S * 4/1974 Nasser ..... D8/384
D280,382 S * 9/1985 Rossi ..... D8/397
4,805,288 A * 2/1989 Cosenza et al. ..... 29/426.5
4,990,043 A * 2/1991 Hafeli et al. ..... 411/280
D363,657 S * 10/1995 Kassardjian et al. ..... D8/354
6,193,456 B1 * 2/2001 Stumpf et al. ..... 411/180
6,273,657 B1 * 8/2001 Vorona ..... 411/82
6,637,994 B2 * 10/2003 Leistner ..... 411/181

OTHER PUBLICATIONS

Pennsylvania Insert Corp., "Specifications of Pulling Iron Pocket", Pennsylvaniainsert.com (Jan. 21, 2002).
CONAC Corp., "Traded Plastic Insert," conacweb.com, date unknown.

* cited by examiner

*Primary Examiner*—Robert Canfield
(74) *Attorney, Agent, or Firm*—Drinker Biddle & Reath LLP

(57) ABSTRACT

A plastic insert for concrete structures includes a barrel for receiving a threaded fastener. According to one embodiment, the insert includes a housing at a distal end receiving an internally threaded member for engaging the threaded fastener. The insert includes bar-engaging members at the distal end for contacting concrete-reinforcing bars of the concrete structure. The insert also includes a bar-engaging member at the proximal end including a retainer defining a substantially semi-circular channel for receipt of a U-shaped portion of a bar. According to another embodiment, the insert includes a base at the distal end extending outwardly from the barrel to define an anchoring surface oriented perpendicular to the barrel axis. Longitudinal ribs on the barrel include segments arranged in series. Each segment of the rib extends radially to a distance that decreases with each succeeding segment such that each segment defines a bearing surface.

5 Claims, 6 Drawing Sheets

INJECTION MOLDED THERMOPLASTIC INSERT

CROSS-REFERENCE TO RELATED APPLICATION

This application claims priority from U.S. Provisional Patent Application No. 60/439,013, filed Jan. 9, 2003, which is incorporated herein by reference in its entirety.

FIELD OF THE INVENTION

The present invention relates to pre-formed inserts, and the like, used with concrete structures.

BACKGROUND OF THE INVENTION

Pre-formed inserts for use with concrete structures are known. The inserts are typically incorporated into the structure during concrete pouring to facilitate attachment of threaded fasteners, such as bolts and the like.

Prior art inserts include internally threaded barrels which are tensioned axially by an attached bolt. The prior art insert also include a base at a distal end of the barrel. The base extends outwardly from the barrel to embed the insert within a concrete structure and increase the force necessary to pull the insert out of the concrete structure. The prior art insert further includes tapering ribs connected to the base and to an outer surface of the barrel to strengthen the base.

Prior art inserts, initially made of metal, have also been made from injection molded thermoplastic (acetal) materials. The inserts are made in a variety of sizes for receiving bolts of various diameters, such as ¼", ⅜", ½", ⅝", ¾", 1", 1½", for example. The metal and plastic inserts of the prior art are similar in construction. The plastic prior art inserts, however, stretch to a greater extent than the corresponding metal inserts because of increased elongation properties of plastic compared to steel. As the barrel of the plastic insert stretches, the reinforcing ribs become wedged against the concrete. Resulting failure of the plastic inserts short of the base creates a smaller shear cone compared to that created by a comparably sized metal insert, which undesirably equates to a lower pull out force for the prior art plastic insert.

SUMMARY OF THE INVENTION

According to the present invention there is provided an insert adapted for receiving a threaded fastener for attachment of the fastener to a concrete structure. Preferably, the insert is made from a plastic material. The insert includes an elongated barrel having opposite proximal and distal ends and defining an interior for receiving a shaft of the threaded fastener.

According to one embodiment of the invention, the insert includes a housing connected to the barrel adjacent the distal end of the barrel. The housing defines an interior adapted to receive an internally threaded member for engagement with a threaded portion of the fastener shaft. The insert further includes at least one bar-engaging member connected to the housing adjacent an outer peripheral edge of the housing and extending outwardly therefrom for contact with a concrete-reinforcing bar of the concrete structure to anchor the insert within the concrete structure.

The insert may also include a bar-engaging member located adjacent the proximal end of the barrel adapted for contact with a concrete-reinforcing bar of the concrete structure. Preferably, the proximal bar-engaging member includes a retainer defining a substantially semi-circular channel adapted for receipt of a U-shaped portion of the concrete-reinforcing bar. Preferably, the retainer is connected to a base defining a substantially cylindrical interior removably receiving the barrel to facilitate receipt of the U-shaped portion of the concrete-reinforcing bar in the channel defined by the retainer.

The insert may also include a cover adapted for removable attachment to the housing such that the interior defined by the housing is enclosed. Preferably the cover includes at least one ring adapted to engage a post connected to the housing. Preferably, the cover is connected to the housing by an elongated flexible connector.

According to another embodiment of the invention, the insert includes a base connected to the barrel adjacent the distal end of the barrel. The base extends outwardly beyond an outer surface of the barrel to define a surface that is oriented substantially perpendicular to a central axis of the barrel for anchoring the insert within the concrete structure.

The insert also includes a plurality of elongated ribs each connected to the base and to the barrel. Each of the ribs includes a plurality of segments arranged in series along the length of the rib and including a first segment located adjacent the base. Each segment of the rib extends radially from an outer surface of the barrel to a distance that decreases with each succeeding segment from the first segment such that each segment defines a surface that is oriented substantially perpendicular to the central axis of the barrel. Preferably, the ribs are spaced substantially equally about a circumference of the barrel. The barrel of the insert preferably includes threads formed on an inner surface of the barrel for threadedly engaging a threaded portion of the fastener shaft.

Preferably, the elongated ribs include ribs of varying lengths and are arranged such that a last segment of each rib remote from the base is offset axially with respect to the barrel from the last segment of adjacent ribs.

BRIEF DESCRIPTION OF THE DRAWINGS

For the purpose of illustrating the invention, there is shown in the drawings a form that is presently preferred; it being understood, however, that this invention is not limited to the precise arrangements and instrumentalities shown. In the drawings.

DETAILED DESCRIPTION OF THE DRAWINGS

Figure 1:
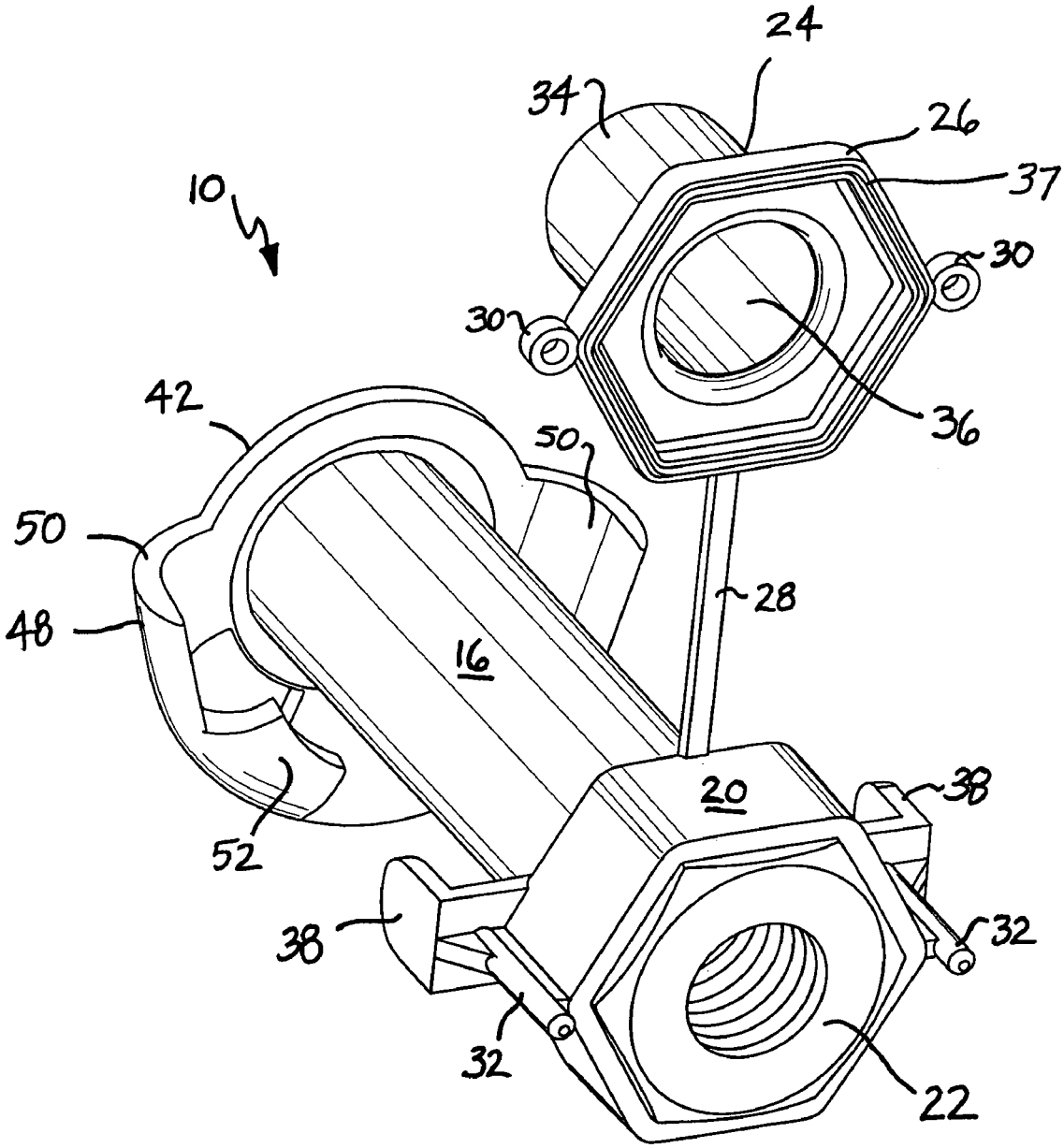
FIG. 1 is a perspective view of an insert according to a first embodiment of the invention.

Referring to the drawings, where like numerals identify like elements, there are illustrated inserts according to the present invention adapted for receiving a threaded fastener, such as a bolt for example. As described in more detail below, the inserts are intended for use in concrete construction to facilitate attachment of a bolt to a poured concrete structure.

Figure 2:
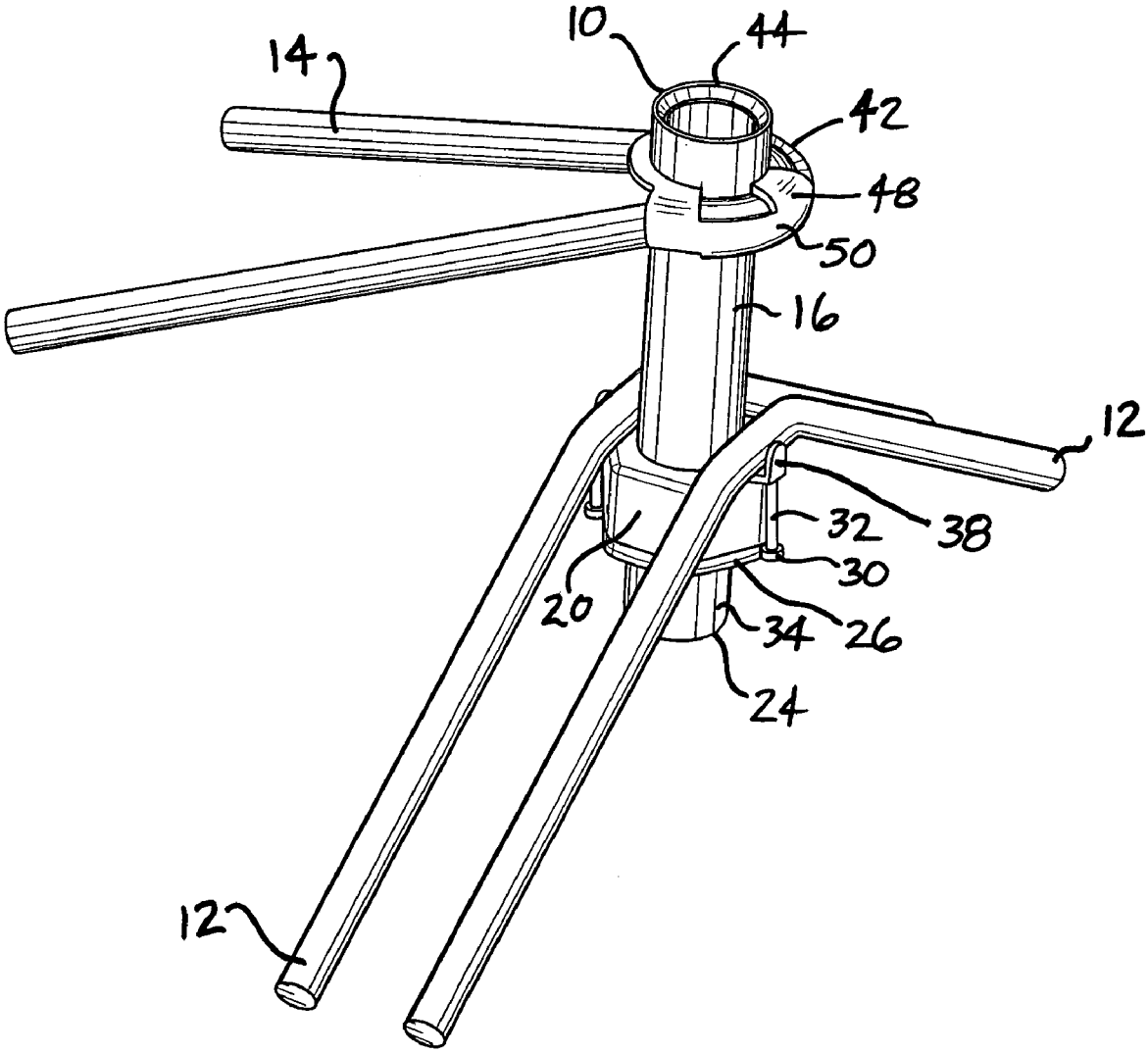
FIG. 2 is a perspective view of the insert of FIG. 1 shown with concrete-reinforcing bars.
Figure 3:
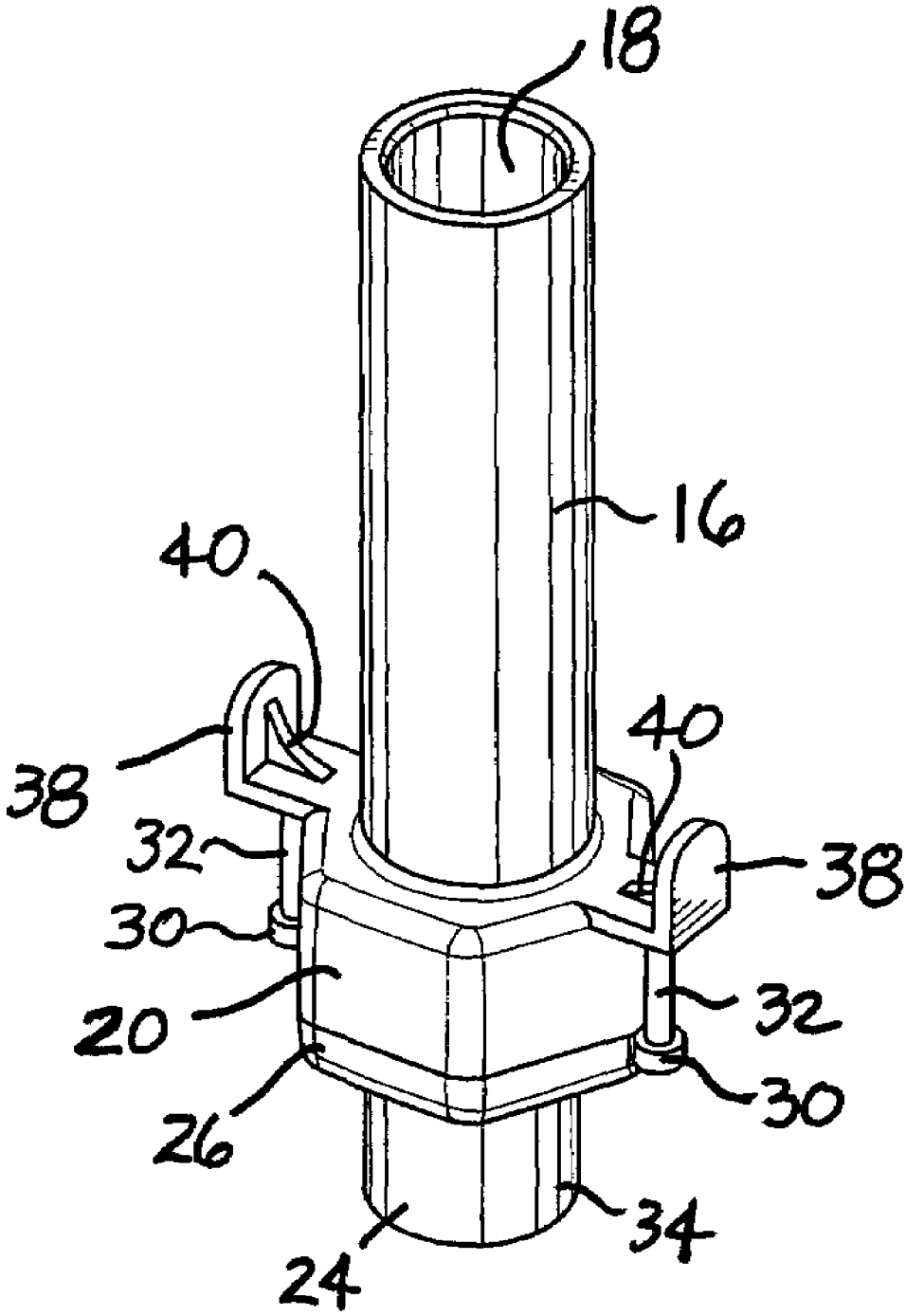
FIG. 3 is a perspective view of the barrel and distal end portion of the insert of FIG. 1.

Referring to FIGS. 1 through 4, there is shown an insert 10 for receiving a threaded bolt according to a first embodiment of the invention. As shown in FIG. 2, the insert 10 is adapted to engage concrete-reinforcing members ("rebar") 12, 14. As described in more detail below, the engagement between the insert 10 and the rebar 12, 14 limits removal of the insert 10 from a concrete structure following pouring and curing of the concrete structure. The force required to remove an embedded insert from a concrete structure is typically referred to as the "pull out" force. As described in more detail below, the engagement between the insert 10 and the rebar 14 also functions to carry shear forces that are applied to an attached bolt in a direction transverse to the longitudinal axis of the bolt.

The insert 10 includes an elongated, substantially cylindrical, barrel 16 defining a hollow interior 18 for receiving the shaft of a bolt. The insert 10 also includes a housing 20 located at a distal end of the insert 10 with respect to a threaded bolt that is received by the insert 10 through an opposite proximal end. The barrel 16 and the housing 20 are preferably integrally formed from an injection molded thermoplastic material. As shown in FIG. 1, the housing 20 defines a substantially hexagonal interior for receipt of a hex-shaped nut member 22. The nut member 22 is internally threaded to provide for threaded engagement between the nut member 22 and an externally threaded portion of a bolt shaft received by the insert 10.

The nut member 22 is preferably made from a metal suitable for forming internal threads that are capable of withstanding loads applied by a metal bolt to be inserted into the insert 10 and tensioned axially. Because the nut member 22 provides for threaded engagement with an inserted bolt, the insert 10 does not need to include threads formed in the barrel 16. This contrasts with prior art plastic inserts that include internal threads formed along the inner surface of the barrel. Also, the location of the metal nut member 22 at the distal end portion of the insert 10 allows for attachment of a bolt having threads formed only at a terminal end portion of the shaft.

The insert 10 also includes a cover 24 including a substantially hexagonally shaped base portion 26 for enclosing the nut member 22 within the interior defined by the housing 20. As shown in FIG. 1, the cover 24 is connected to the housing 20 of insert 10 by a flexible connector 28. Preferably, the cover 24 and connector 28 are integrally formed with the housing 20 from an injection molded thermoplastic material. It is not required, however, that the cover 24 be connected to the housing 20 by the flexible connector 28. The cover 24 could be formed as a separate component attachable to the housing 20. The integral construction incorporating the flexible connector 28, however, facilitates handling of the insert 10 prior to placement of the nut member 22 into the interior of the housing 20.

The enclosed location of the nut member 22 within the housing 20 ensures that the nut member will remain properly positioned with respect to the insert 10 for threaded engagement with a bolt received by the insert. The enclosure provided by the cover 24 also serves to protect the nut member 22 from contamination when concrete is placed around the insert thereby ensuring that the threads of the nut member 22 will threadedly engage a subsequently attached bolt.

The cover 24 includes substantially ring shaped snap-attachment members 30 located at opposite sides of the base portion 26. The insert 10 also includes posts 32 projecting from the housing 20 at opposite sides thereof, as shown in FIG. 1. The posts 32 are adapted for engagement with the snap-attachment members 30 of cover 24 to secure the cover 24 to the housing 20 in the closed position shown in FIG. 3. The cover 24 also includes a cap portion 34 connected to the base portion 26. The cap portion 34 of cover 24 defines an interior 36 forming an extension of the enclosed interior defined by the housing 20 for receiving a portion of the shaft of an attached bolt that may extend past the nut member. The interior 36 provided by the cap portion 34, therefore, accommodates bolts having various lengths.

Referring to FIG. 1, the cover 24 includes a rib-like formation 37 extending about the base portion 26 adjacent an outer periphery thereof. This location provides for contact between the rib-like formation 37 and the housing 20 when the cover 24 is attached to the housing for ultrasonically welding the cover 24 to the housing 20 to seal the interior containing the nut member 22. Alternatively, the interior containing the nut member 22 could be sealed using a caulking material.

The insert 10 also includes angles 38 connected to the housing 20 at opposite sides thereof. Each of the angles 38 is adapted for receiving one of the rebars 12 such that the rebar is located between the angle 38 and barrel 16 as shown in FIG. 2. Contact between the rebars 12 and the angles 38 increases the pull out force for an installed insert.

The insert 10 also includes a gusset 40 connected to each angle 38. The gusset 40 reinforces the associated angle 38 to strengthen the angle 38 against loads transferred from contact with one of the rebars 12. For ease of illustration, the rebars 12, 14 have been illustrated in FIG. 1 without surface texture. As is well known in the art, however, rebar is typically provided with an external surface treatment, such as helical ribbing for example, to facilitate engagement between the rebar and concrete placed around the rebar. The gusset 40, therefore, will also desirably engage the rebar surface ribbing to limit relative movement between the insert 10 and the rebar 12.

Figure 4:
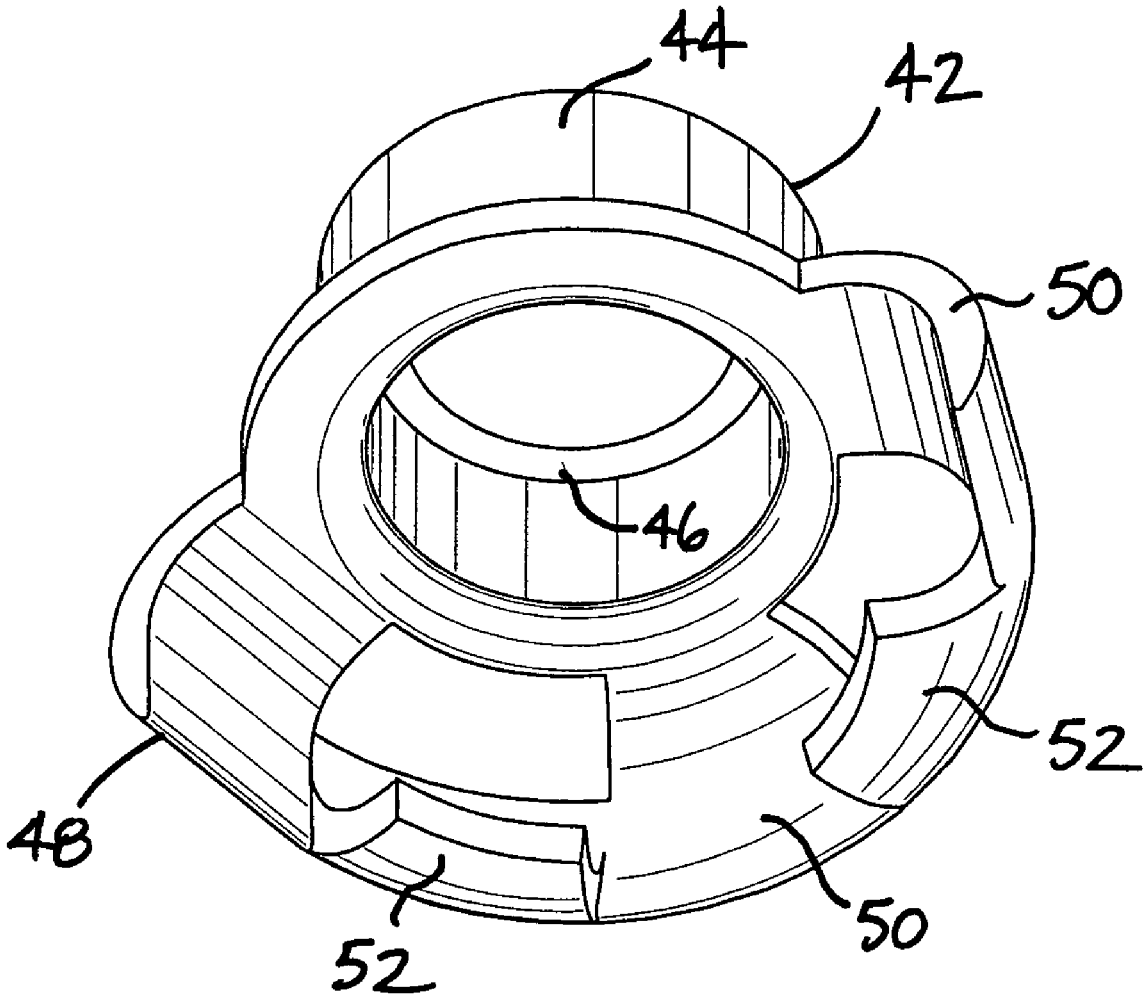
FIG. 4 is a perspective view of the proximal end portion of the insert of FIG. 1.

Referring again to FIG. 1, the insert 10 further includes a rebar receiver 42 connected to the barrel 16 and located at the proximal end of the insert 10. As shown in FIG. 4, the rebar receiver 42 is preferably formed separately from the barrel 16 from a thermoplastic material. The rebar receiver 42 includes a substantially cylindrical body portion 44 defining an interior in which an end portion of the barrel 16 is received, as shown in FIG. 1. An annular shoulder 46 is defined within the body portion 44 of the rebar receiver 42 to provide a hard stop for limiting the insertion of the barrel 16 into the rebar receiver 42. The barrel 16 and the body portion 44 of the rebar receiver 42 may also be dimensioned to create a slight interference therebetween for retaining the barrel 16 in an inserted position with respect to the rebar receiver 42.

The rebar receiver 42 also includes a retainer 48 connected to the body portion 44 adjacent one end of the body portion, as shown in FIG. 4. The retainer 48 includes an arcuate rim 50 defining a substantially semi-circular channel extending partially around the body portion 44. The retainer 48 further includes a pair of extensions 52 extending inwardly from a peripheral edge of the rim 50.

Referring to FIG. 2, a substantially U-shaped bend is formed in the rebar 14 that is sized for receipt within the channel defined by the rim 50 of retainer 48. With the U-shaped bend of the rebar 14 received in the channel of the retainer 48, the barrel 16 is then received within the body portion 44 of the rebar receiver 42 to limit lateral movement of the rebar 14 with respect to the insert 10. The engagement between the rebar 14 and the rebar receiver 42 serves to strengthen the insert 10 against shearing forces applied to the insert 10 adjacent the proximal end by transverse loading of an attached bolt. The barrel 16 of insert 10 is illustrated in FIG. 1 inserted into the rebar receiver 42 prior to receipt of the rebar 14 for ease of illustrating the components of the insert 10. As described above, however, the rebar receiver 42 will be separated from the barrel 16 during placement of the U-shaped bend of rebar 14 into the retainer 48 of rebar receiver 42.

Figure 5:
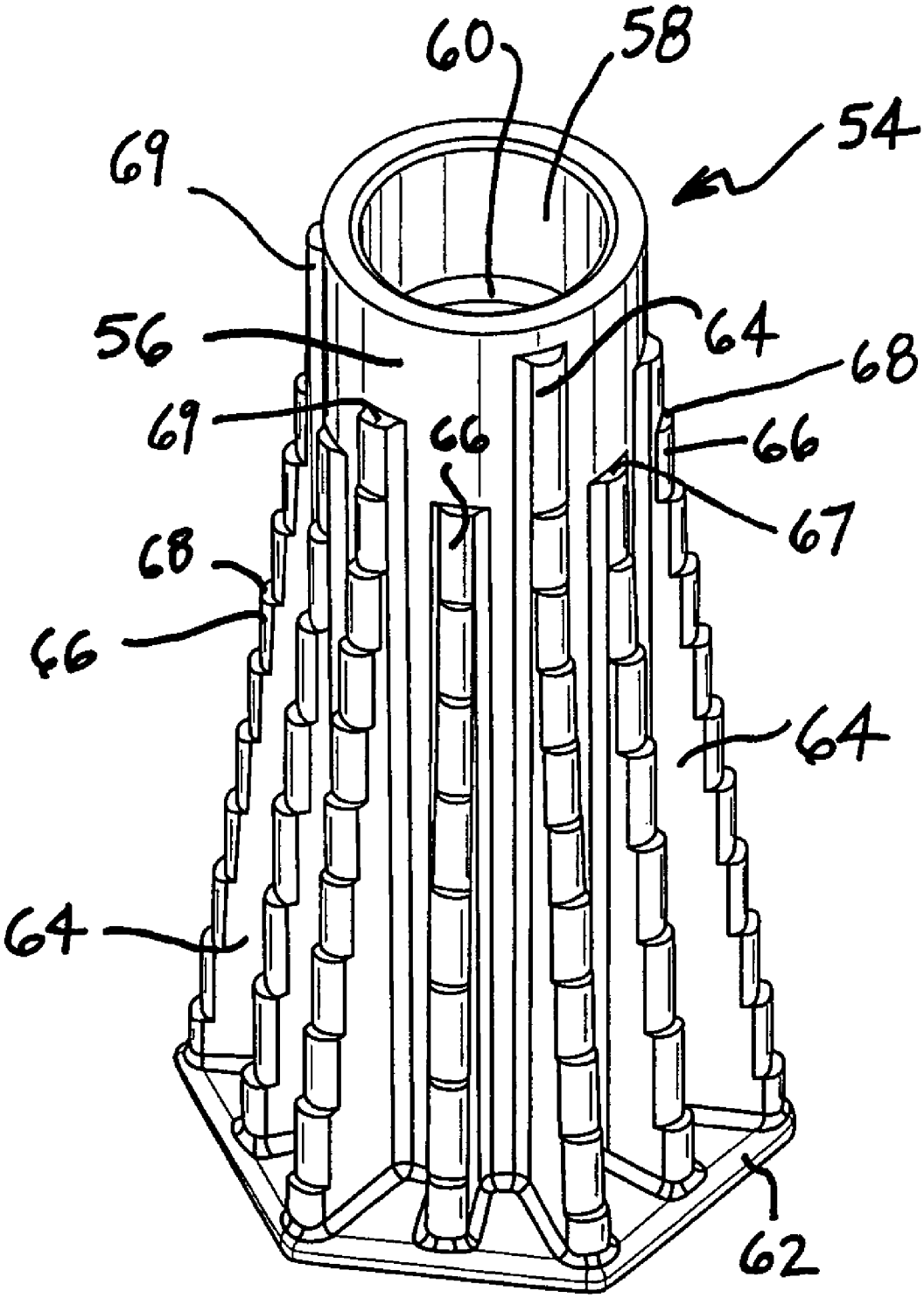
FIGS. 5 and 6 are perspective views of inserts according to a second embodiment of the invention.

Referring to FIG. 5 there is shown an insert 54 for receiving a threaded bolt in a concrete structure according to a second embodiment of the invention. Preferably, the insert 54 is made from an injection molded thermoplastic material. The insert 54 includes an elongated, substantially cylindrical, barrel 56 defining a hollow interior 58 for receiving the shaft of a bolt. Threads 60 are defined on an inner surface of the barrel 56 for engagement with external threads on the shaft of a bolt received by the insert 54. Preferably, the internal threads extend along a majority of the length of the barrel 56.

The insert 54 also includes a base 62 connected to the barrel 56 at a distal end of the insert 54 with respect to a bolt inserted into the insert 54. The base 62 extends outwardly beyond an outer surface of the barrel 56 in a radial direction with respect to the barrel 56 to define a surface that is oriented substantially perpendicular to the axis of the barrel 56. When a concrete structure, such as a wall for example, has been formed around the insert 54, the outwardly extending surface of the base 62 serves to anchor the insert 54 within the surrounding concrete.

The insert 54 also includes a plurality of ribs 64 at spaced locations about the circumference of the barrel 56. Each of the ribs 64 includes sides connected to the barrel 56 and to the base 62 to reinforce the connection therebetween against shear load applied to the base 62 from an axially loaded barrel 56. The ribs 64 also create with the base 62 a shear cone in the surrounding concrete increasing the pull out force for the insert 54.

As shown, the ribs 64 are not tapered along their lengths and, instead, include a series of stepped segments 66 each extending radially from the barrel to a distance that diminishes with each succeeding segment from a first segment that is located adjacent the base 62. As shown in FIG. 5, this construction defines a bearing surface 68 for each segment 66 that is substantially perpendicular to the axis of the barrel 56. Each of the perpendicular bearing surfaces 68 of a rib 64 provides an anchoring surface engaging the surrounding concrete to resist loading applied by a tensioned bolt. The spacing of the bearing surfaces 68 along the rib 64, as shown in FIG. 5, serves to distribute forces thereby promoting more efficient and uniform transfer of applied loading between the insert 54 and the surrounding concrete and between the barrel 56 and the base 62. The efficient distribution of applied load limits wedging failures associated with prior art plastic inserts that had undesirably reduced shear cone size, and therefore, reduced pull out force, for the insert.

The ribs 64 are not uniform in length. As shown, the ribs 64 that are shortest in length have a last stepped segment 66 remote from base 62 having a terminal end 67 that is located longitudinally along the barrel 56 adjacent to an end of the internal threads 60 formed on the barrel 56. As shown, the ribs 64 that are shortest in length include every other rib and therefore comprise approximately one-half of the ribs 64. Extension of the ribs 64 beyond this point along the unthreaded end portion of the barrel 56 would not significantly increase pull out force for the insert 54 because the end portion of the barrel 56 will not be stretched by a tensioned bolt. Terminating ribs 64 to the shortened length adjacent the end of the threads, therefore, desirably eliminates unnecessary material from the insert 54. Some of the ribs 64, however, include a last segment that extends along the unthreaded portion of the barrel 56, as shown. These ribs provide projecting surfaces on the outer surface of the unthreaded portion of the barrel to facilitate removal of the insert 54 from the mold during manufacture. To optimize material reduction, however, only a portion of these ribs include a last segment that extends substantially to the proximal end of the barrel 56.

As shown in FIG. 5, the longitudinal length of the segments 66 of a given rib 64 is different from that of adjacently located ribs. As a result, the bearing surfaces 68 are staggered such that the bearing surfaces of each of the ribs 64 is offset longitudinally with respect to those of adjacently located ribs 64. This arrangement desirably limits the formation of propagating shear cracks compared to a construction having uniformly located bearing surfaces such that a shear crack could propagate circumferentially around the barrel 56 at a given longitudinal location.

Figure 6:
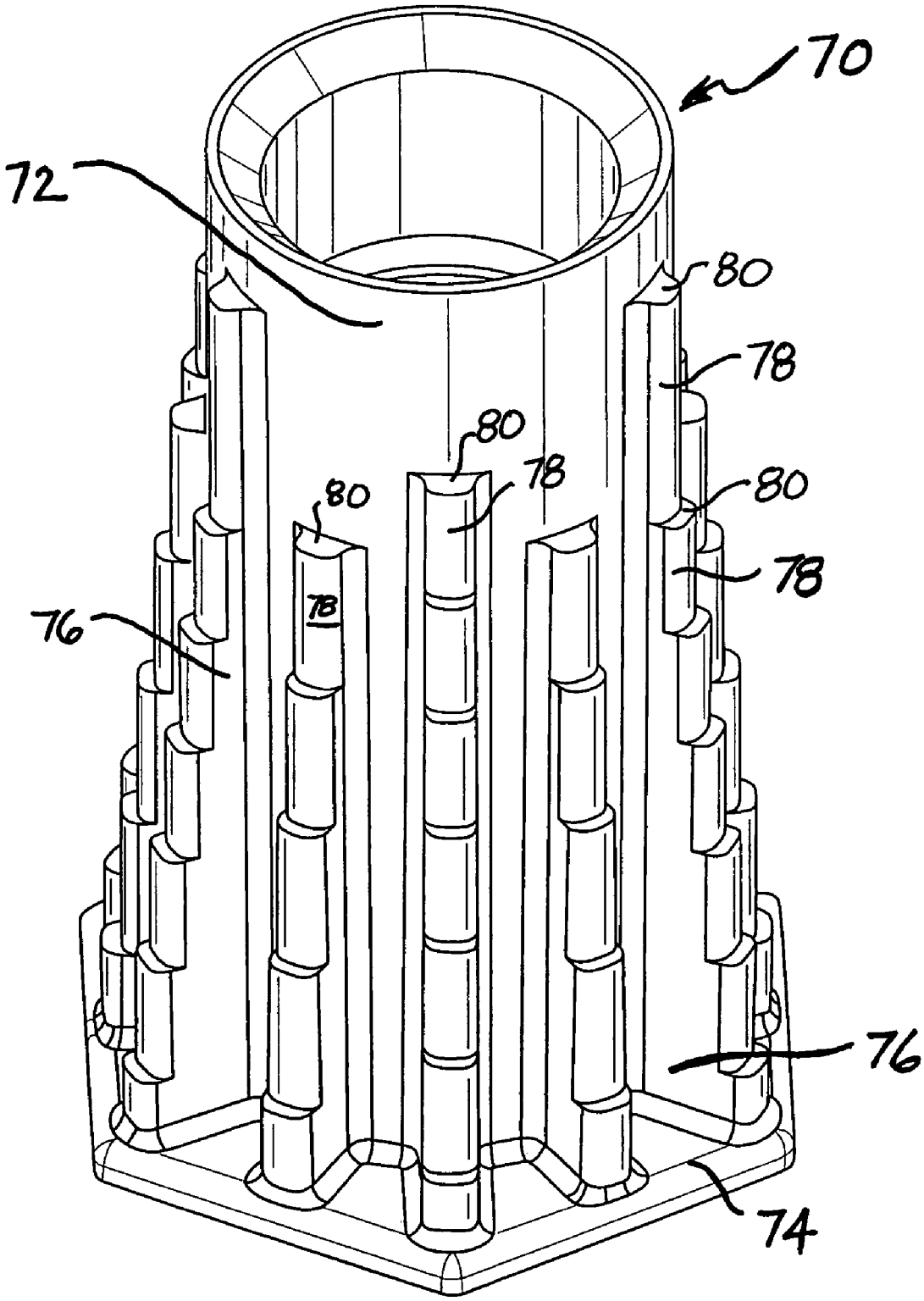

Referring to FIG. 6, there is shown an alternative insert 70 including an internally threaded barrel 72, a base 74, and interconnecting ribs 76 having stepped segments 78 defining perpendicular bearing surfaces 80 to promote efficient load distribution. The ribs 76 have varying lengths and incorporate varying segment lengths to stagger the bearing surfaces 80 in a similar fashion as insert 54. As may be seen by comparing FIGS. 5 and 6, however, insert 70 is adapted for receipt of a bolt having a relatively large bolt diameter to length ratio compared to that associated with insert 54. Accordingly, the ribs 76 of insert 70 include fewer stepped segments 78 on average compared to the ribs 64 of insert 54.

The load distribution provided by the stepped configuration of inserts 54, 70 desirably increases shear cone size created in the surrounding concrete over prior plastic inserts to that approaching the shear cone sizes created by corresponding sized metal inserts. Increased shear cone size results in increase in pull out force. It was found that thermoplastic inserts incorporating the stepped rib construction of the present invention provided an increase of 10 to 30 percent over similarly sized plastic inserts of the prior art having tapering ribs. Using injection molded plastic material, the stepped configuration of inserts 54, 70 can also be accomplished without increasing mold cycle time and without complicating the moldability of the insert. In fact, it was found that the stepped rib construction of the present invention actually resulted in reduction in material and a corresponding reduction in mold cycle time because of reduced time required for curing. The reduction in material and mold cycle time was found to provide a reduction in production costs of approximately 30 percent.

The foregoing describes the invention in terms of embodiments foreseen by the inventor for which an enabling description was available, notwithstanding that insubstantial modifications of the invention, not presently foreseen, may nonetheless represent equivalents thereto.

What is claimed is:

1. An insert for incorporation into a concrete structure to facilitate attachment of a threaded fastener to the concrete structure, the insert comprising:

an elongated barrel defining an interior for receiving a shaft, the barrel including opposite proximal and distal ends and an opening at the proximal end;

a base connected to the barrel adjacent the distal end of the barrel, the base extending outwardly beyond an outer surface of the barrel to define a surface oriented substantially perpendicular to a central axis of the barrel for anchoring the insert within the concrete structure; and a plurality of spaced elongated ribs each connected to the base and to the barrel, each rib including a plurality of stepped segments arranged in series along the length of the rib and including a first segment located adjacent the base, each segment of the rib extending radially from an outer surface of the barrel to a distance that decreases with each succeeding segment from the first segment such that each segment defines a bearing surface that is oriented substantially perpendicular to the central axis of the barrel.

2. The insert according to claim 1, wherein the barrel further includes threads formed on an inner surface of the barrel for threadedly engaging a threaded portion of the fastener shaft.

3. The insert according to claim 1, wherein the ribs are spaced substantially equally about a circumference of the barrel.

4. The insert according to claim 1, wherein the plurality of elongated ribs includes ribs of varying lengths such that a last segment of at least one rib located remote the base is offset longitudinally from the last segment of an adjacently located rib.

5. The insert according to claim 1, wherein the segments of the ribs are varied in length such that the bearing surfaces of each rib are offset longitudinally with respect to the bearing surfaces of adjacently located ribs.

* * * * *